United States Patent [19]

Dafter, Jr.

[11] 4,021,314

[45] May 3, 1977

[54] METHOD OF DEPOSITING A METAL ON A SURFACE

[75] Inventor: Robert Vincent Dafter, Jr., Ewing Township, Mercer County, N.J.

[73] Assignee: Western Electric Company, Inc., New York, N.Y.

[22] Filed: Mar. 25, 1976

[21] Appl. No.: 670,496

[52] U.S. Cl. ..... 204/30; 427/301; 427/304; 427/305; 427/306; 427/307; 106/1

[51] Int. Cl.[2] ..... C25D 5/56

[58] Field of Search ..... 427/301, 304–307; 106/1; 204/30

[56] References Cited

UNITED STATES PATENTS

| | | | |
|---|---|---|---|
| 3,671,291 | 6/1972 | Miller | 427/306 |
| 3,769,061 | 10/1973 | Dutkewych et al. | 204/30 |
| 3,963,590 | 6/1976 | Deyrup | 427/306 |

FOREIGN PATENTS OR APPLICATIONS

| | | | |
|---|---|---|---|
| 29,242 | 12/1968 | Japan | 427/306 |

*Primary Examiner*—R. L. Andrews
*Attorney, Agent, or Firm*—J. Rosenstock

[57] ABSTRACT

A method of depositing a metal on a dielectric surface is disclosed. The method comprises treating the surface with a stable hydrosol obtained by mixing and heating together in an acidic aqueous medium (1) a salt of a noble metal with (2) an organic compound containing at least two oxygen atoms selected from (a) an organic carbonate having a structural formula of

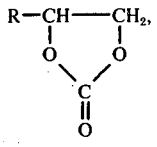

where R = H, an alkyl radical, (b) ethylene glycol and (c) 1,3 dioxane. The treated surface is then exposed to a suitable electroless metal deposition solution to catalytically deposit an electroless metal deposit thereon.

4 Claims, No Drawings

METHOD OF DEPOSITING A METAL ON A SURFACE

BACKGROUND OF THE INVENTION

1. Field of the Invention

This invention relates to a method of depositing a metal on a dielectric surface and, more particularly, to depositing a metal on a dielectric surface by means of an electroless metal deposition process.

2. Discussion of the Prior Art

It is commonplace today to generate metallic patterns or deposits on electrically insulative or dielectric surfaces by means of electroless metal deposition techniques. Conventionally, aqueous sensitizer and/or activator solutions are employed wherein a catalytic activating metal is deposited on the surface which catalyzes electroless metal deposition from a suitable electroless metal deposition solution. Where the surface to be metallized is hydrophobic, as for example in the case of most organic polymeric substrate surfaces, it is often very difficult to achieve wetting thereof by the aqueous sensitizing and/or activating solutions thereby leading to electroless metal deposits which are discontinuous and/or have poor adhesion to the surface metallized.

A method of electrolessly metal depositing such hydrophobic surfaces with a continuous and adherent deposit is desired and needed.

SUMMARY OF THE INVENTION

This invention relates to a method of depositing a metal on a dielectric surface and more particularly, to depositing a metal on a dielectric surface by means of an electroless metal deposition process.

The method comprises treating the surface with a stable hydrosol obtained by mixing and heating together in an acidic aqueous medium (1) a salt of a noble metal with (2) an organic compound containing at least two oxygen atoms selected from the group consisting of (a) an organic carbonate having the structural formula of

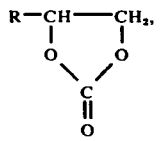

where R is a substituent selected from the group consisting of an alkyl radical and the hydrogen atom, (b) ethylene glycol and (3) 1,3 dioxane. The treated surface is exposed to a suitable electroless metal deposition solution to catalytically deposit an electroless metal deposit thereon.

DETAILED DESCRIPTION

The present invention will be discussed primarily in terms of electrolessly depositing Cu metal on a dielectric surface by means of an electroless metal deposition cataylst comprising a catalytic Pd species or a catalytic Ag species. It will be readily appreciated that the inventive concept is equally applicable to electrolessly depositing other suitable metals which are catalytically reduced from their respective ions by other catalytic activating metals (noble metals) such as Pt, Au, Ir, Os, Rh, Ru, or catalytic species thereof.

A suitable substrate is selected. For the production of electrical circuit patterns, suitable substrates are those which are generally electrically non-conductive. In general all dielectric materials are suitable substrates. Dielectric materials commonly employed comprise a resinous material. If desired, the resinous material may incorporate fibrous reinforcement. For instance, paper or cardboard, glass fiber or other fibrous material may be impregnated with a phenolic, epoxy or fluorohydrocarbon (e.g., polytetrafluoroethylene) resinous material and pressed or rolled to a uniform thickness. Ceramic substrates may likewise be selected.

A surface of the substrate, e.g., a polyimide substrate, a polytetrafluoroethylene substrate, is treated with a universal electroless metal deposition catalyst, of the subject invention, to render the surface capable of being electrolessly metal deposited by exposure to a suitable electroless metal deposition solution. By the use of the term "universal" is meant that the catalyst is one which is effective for the electroless deposition of a void-free and adherent metal deposit on a hydrophilic surface, e.g., a ceramic surface, as well as on a hydrophobic surface, e.g., an organic polymer surface, on a surface which is swelled thereby, e.g., a polyimide surface, or on a surface which is not swelled thereby, e.g., a polytetrafluoroethylene surface. Additionally, it is to be pointed out that hydrophobic surfaces, e.g., polyimide surfaces, polytetrafluoroethylene surfaces, treated by the catalyst of the present invention, do not appear to be either wetted by the catalyst nor rendered hydrophilic by the catalyst.

The universal catalyst of the present invention is one which is capable of participating in an electroless metal deposition catalysis, either by initially existing as a catalytic noble metal (atomic) or by subsequently being converted into or forming a catalytic noble metal species (ionic and/or atomic). By the term "catalytic noble metal species" is meant a noble metal species, e.g., a metal, which serves as a reduction catalyst in an autocatalytic electroless metal deposition. For example, a universal catalyst comprising a catalytic palladium species is one which can initially exist (1) as a catalytic atomic species, i.e., catalytic palladium metal ($Pd^{\circ}$); (2) as a catalytic ionic species, i.e., $Pd^{+2}$ ions, which is subsequently converted into catalytic palladium metal, as by reduction with a suitable reducing agent, e.g., formaldehyde, hydrazine, etc.; or (3) as both a catalytic palladium atomic species and a catalytic palladium ionic species.

The universal catalyst of the present invention comprises a stable hydrosol and is prepared by first mixing or combining together a noble metal salt, e.g., $PdCl_2$, $AgNO_3$, etc., and a suitable organic compound containing at least two oxygen atoms. The salt and the organic compound are mixed in an acidic aqueous medium, e.g., a 5 weight percent aqueous HCl solution. The resultant mixture is maintained at or heated to an elevated temperature, e.g., 65°–75° C., for a sufficient period of time, e.g., 15–30 minutes at 65°–75° C., whereby a stable hydrosol is formed. By a stable hydrosol is meant a hydrosol which is homogeneous in that there is no agglomeration of the colloidal particles contained therein and also there is no occurrence of a distinct liquid-liquid phase separation.

Suitable noble metal salts are those comprising salts of Pd, Pt, Ag, Au, etc., which are soluble in an acidic aqueous medium. Some typical salts include the noble metal nitrates, halides, e.g., chlorides, bromides, fluorides, iodides, etc. The amount of the noble metal salt employed should be sufficient to deposit an adequate catalytic species concentration on the substrate surface whereby a continuous, void-free and adherent electroless metal deposit will be obtained. However, the amount of the noble metal salt should not be so large as to deposit too large a catalytic species concentration on the surface whereby the resultant electroless metal deposit will lose adhesiveness and result in poor adhesion to the surface being treated. Typically, for Pd salts, e.g., $PdCl_2$, the amount employed ranges from 0.025 weight percent of the mixture to 0.075 weight percent of the mixture. A concentration of a Pd salt of less than 0.025 weight percent results in a spotty electroless metal deposit and a concentration of greater than 0.075 weight percent results in a deposit having poor adhesion.

Suitable organic compounds include liquid organic carbonates having a structural formula of

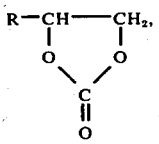

where R is a hydrogen atom or an alkyl radical such as $CH_3$, $C_2H_5$, etc. Preferred carbonates are ethylene carbonate (R = H) and propylene carbonate ($R = CH_3$). Other suitable organic compounds include ethylene glycol and 1,3 dioxane. The preferred amount of the organic compound employed has been found to be at least 50 volume percent (e.g., 81 weight percent of propylene carbonate) of the resultant mixture. If less than 50 volume percent is employed, a spotty electroless metal deposition is obtained.

It is to be pointed out that in order to obtain a stable hydrosol which functions as a universal catalyst, the aqueous medium must be acidic. That is, the mixing of the noble metal salt and the organic compound must be done in a water medium which has been acidified by a suitable acid, e.g., HCl, $H_2SO_4$, etc. Additionally, the pH of the resultant mixture should be controlled to prevent the formation of a discontinuous electroless metal deposit and to preserve the stability of the resultant hydrosol, as by preventing flocculation from occuring therein. It has been found that a pH ranging from 0.3 up to but less than 4.0 is preferred. If the pH is less than 0.3 a discontinuous electroless metal deposit may be obtained. If the pH is 4.0 or greater, then the hydrosol becomes unstable and a noble metal hydrous oxide or other oxygen containing species thereof precipitates therefrom and electroless metal deposition with the use thereof will not take place.

It is of course to be understood that the concentrations of both the noble metal salt and the organic compound employed as well as the pH maintained depends upon the particular compounds selected whereby a stable catalytic hydrosol is obtained. In this regard, such concentrations and pH maintenance are known or are easily ascertained experimentally by one skilled in the art in the light of the subject invention disclosed herein.

The mixture is heated at temperatures above room temperaure (25° C.) ranging up to the boiling point of the mixture for a period of time sufficient to form the stable hydrosol. The stable hydrosol is typically characterized by a dark colored sol which does not change color upon additional heating, i.e., the color of the resultant sol remains constant with time at a particular temperature. Typically, the mixture is heated at 65°–75° C. for a period of time ranging from 15 minutes to several hours whereby a stable hydrosol is obtained.

It is to be pointed out hereat that the time and temperature parameters for forming a stable hydrosol are interdependent and that variations in the temperature will require variations in the time whereby a stable catalytic hydrosol will be obtained. In this regard, the various parameters and their interaction between one another are known or can be easily ascertained by one skilled in the art in the light of the subject invention disclosed herein.

It is to be noted hereat that the colloidal particles contained in the hydrosol are hypothesized to be a hydrous oxide of the noble metal which has been complexed in some manner with the organic compound. However, it is to be stressed that the exact species or species contained in the hydrosol are not known and the subject invention is not to be limited thereby or to any hypothesis or mechanism.

The surface of the substrate is then treated with the universal catalyst, employing any conventional technique such as spraying, spin coating, dipping, etc., whereby the surface is catalyzed by forming thereon a layer or coat of the hydrosol, which layer or coat is capable of participating in an electroless metal deposition catalysis. Preferably, the substrate surface is immersed in the hydrosol at the elevated temperature of its formation, e.g., 65°–75° C., for a short period of time, e.g., typically one minute, whereafter it is removed therefrom.

The hydrosol treated substrate surface may then be water rinsed and is then treated, as for example by immersion, with a suitable electroless metal deposition solution, wherein, sequentially, (1) a catalytic noble metal species, e.g., Pd metal, is formed if not already present, and (2) an electroless metal ion, e.g., $Cu^{+2}$, is reduced to the metal, e.g., $Cu^{o}$, and catalytically deposited on the surface to form an electroless metal deposit. A suitable electroless metal deposition solution comprises a metal ion, e.g., $Cu^{+2}$, which is catalytically reduced to its corresponding metal, e.g., $Cu^{o}$, by a suitable reducing agent, e.g., formaldehyde, in the presence of a catalytic noble metal species such as a noble metal. A suitable reducing agent is one which (1) is capable of reducing a noble metal ionic species to a catalytic noble metal species such as a noble metal and (2) is capable of reducing the electroless metal ions to the corresponding electroless metal. The electroless metal deposit may then be further built up or electroplated in a standard electroplating bath.

It is to be noted that the various typical electroless and electroplating solutions and the plating conditions and procedures are well known in the art and will not be elaborated herein. Reference in this regard is made to *Metallic Coating of Plastics*, William Goldie, Electrochemical Publications, 1968.

It is also to be noted that the invention disclosed herein may be employed for selective metallization whereby a metal pattern is obtained. Conventional masking and lithographic techniques, well known in the art, may be employed to obtain such metal patterns such for example in the production of electrical circuit patterns on a non-conductive substrate.

EXAMPLE I

An electroless metal deposition catalyst (hydrosol) was prepared in the following manner. Three hundred ml. (366 grams) of propylene carbonate was heated to a temperature in the range of 65°–75° C. One hundred ml. (100 grams) of deionized water was added to the heated propylene carbonate and the mixture was maintained at 65°–75° C. until a homogeneous solution comprising 75 volume percent propylene carbonate was obtained (60–90 minutes). Twenty-five grams of an aqueous solution comprising 0.5 weight percent $PdCl_2$ and 0.5 weight percent HCl was added to the aqueous propylene carbonate solution maintained at 65°–75° C. The solution had a pH of 2. After 15 minutes the solution turned from an initial red color to a constant dark brown color and a stable hydrosol formed.

A plurality of hydrophobic substrates were then treated with the resultant hydrosol. The substrates were (1) a polyimide substrate; (2) a polytetrafluoroethylene substrate; (3) a polyethylene terephthalate substrate; (4) a polypropylene substrate; and (5) a rubber-modified epoxy substrate. Each of the substrates was immersed in a bath comprising the hydrosol and maintained at 65°–75° C. for one minute and then removed. Each substrate was then water rinsed for one minute and then immersed in a commercially obtained electroless metal plating bath comprising cupric sulfate, formaldehyde, a complexer and caustic. A 5–8$\mu$ inch continuous and adherent electroless copper deposit was obtained on the substrate.

The following observations were made:

1. the hydrosol did not wet any of the substrates as evidenced by beading of the hydrosol on the surfaces upon removal from the hydrosol bath;
2. the hydrosol swelled the polyimide film as determined by a weight gain thereof;
3. the hydrosol did not swell the polytetrafluoroethylene substrate; and
4. the hydrosol did not render any of the substrate surfaces hydrophilic as evidenced by the beading of water on the surfaces after rinsing therewith.

EXAMPLE II

The procedure of Example I was repeated except that the hydrosol was prepared from a 50 volume percent (81 weight percent) aqueous propylene carbonate solution. The solution had a pH of 2. Substantially the same results as of Example I were obtained, except that the resultant electroless deposit exhibited a somewhat lower adhesion.

EXAMPLE III

For comparison purposes, the procedure of Example I was repeated except that the hydrosol was prepared from a 12 volume percent aqueous propylene carbonate solution. The solution had a pH of 2. A discontinuous metallization was obtained.

EXAMPLE IV

The procedure of Example I was repeated except that the $PdCl_2$ was added in the form of an aqueous solution containing 0.16 weight percent $H_2SO_4$. The pH of the reaction mixture was hydrosol was about 2. Substantially the same results were obtained.

EXAMPLE V

A. The procedure of Example I was repeated except that 0.075 weight percent $PdCl_2$ was contained in the hydrosol. Substantially the same results were obtained.

B. The procedure of Example I was repeated except that less than 0.025 weight percent of $PdCl_2$ was contained in the hydrosol. A discontinuous metallization was obtained.

C. The procedure of Example I was repeated except that one weight percent of $PdCl_2$ was contained in the hydrosol. A copper deposit was obtained which did not adhere to the surfaces of the substrates.

EXAMPLE VI

The procedure of Example I was repeated except that the pH of the hydrosol was 4.0. A stable hydrosol was not obtained as evidenced by agglomeration. Also the mixture obtained did not catalyze any of the surfaces as evidenced by no metallization upon subsequent immersion in the electroless metal deposition bath for 10 minutes.

EXAMPLE VII

The procedure of Example I was repeated except that $AgNO_3$ was added to the aqueous propylene carbonate solution to form a mixture containing one weight percent $AgNO_3$. The pH of the mixture was about 2. Substantially the same results of Example I were obtained.

EXAMPLE VIII

The procedure of Example I was repeated except that 75 volume percent (78.54 weight percent) aqueous ethylene carbonate solution was employed. Substantially the same results were obtained.

EXAMPLE IX

The procedure of Example I was repeated except that a 75 volume percent (79 weight percent) aqueous 1,3 dioxane solution was employed. Substantially the same results were obtained.

EXAMPLE X

The procedure of Example I was repeated except that a 75 volume percent aqueous ethylene glycol solution was employed. Substantially the same results were obtained.

EXAMPLE XI

The procedure of Example I was repeated except that 0.3 gram of $PdCl_2$ was added to propylene carbonate at 65°–75° C. The solution was acidified to a pH of 2. No metallization on any of the substrates was obtained.

It is to be understood that the abovedescribed emobodiments are simply illustrative of the principles of the invention. Various other modifications and changes may be made by those skilled in the art which will embody the principles of the invention and fall within the spirit and scope thereof.

What is claimed is:

1. A method of depositing a metal on a dielectric surface which comprises:

treating the surface with a stable hydrosol obtained by mixing and heating together in an acidic aqueous medium (1) a salt of a noble metal with (2) an organic compound containing at least two oxygen atoms selected from the group consisting of (a) an organic carbonate having a structural formula of

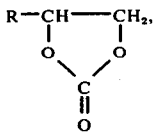

where R is a member selected from the group consisting of an alkyl radical and a hydrogen atom, (b) ethylene glycol, and (c) 1,3 dioxane; and exposing said treated surface to a suitable electroless metal deposition solution to catalytically deposit an electroless metal deposit thereon.

2. The method as defined in claim 1 wherein said organic carbonate comprises ethylene carbonate.

3. The method as defined in claim 1 wherein said organic carbonate comprises propylene carbonate.

4. The method as defined in claim 1 which further comprises:

electroplating said electroless metal deposit to electrodeposit a metal thereon.

* * * * *

UNITED STATES PATENT OFFICE

CERTIFICATE OF CORRECTION

Patent No. 4,021,314 Dated May 3, 1977

Inventor(s) Robert Vincent Dafter, Jr.

It is certified that error appears in the above-identified patent and that said Letters Patent are hereby corrected as shown below:

In the specification, Column 4, line 67, "such for" should read --used for--. Column 5, line 67, "was hydrosol" should read --and hydrosol--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*